US009083106B2

(12) United States Patent
Lin

(10) Patent No.: US 9,083,106 B2
(45) Date of Patent: Jul. 14, 2015

(54) RECEPTACLE CONNECTOR

(71) Applicant: Yu-Yuan Lin, Taipei (TW)

(72) Inventor: Yu-Yuan Lin, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 177 days.

(21) Appl. No.: 13/674,962

(22) Filed: Nov. 13, 2012

(65) Prior Publication Data

US 2013/0137283 A1 May 30, 2013

Related U.S. Application Data

(60) Provisional application No. 61/563,616, filed on Nov. 25, 2011.

(51) Int. Cl.

| | |
|---|---|
| ***H01R 13/44*** | (2006.01) |
| ***H01R 13/518*** | (2006.01) |
| ***H01R 12/70*** | (2011.01) |
| ***H01R 12/72*** | (2011.01) |
| ***H01R 13/627*** | (2006.01) |
| *H01R 12/75* | (2011.01) |
| *H01R 24/64* | (2011.01) |

(52) U.S. Cl.

CPC ..... *H01R 13/518* (2013.01); *H01R 12/7052* (2013.01); *H01R 12/722* (2013.01); *H01R 13/6275* (2013.01); *H01R 12/75* (2013.01); *H01R 24/64* (2013.01)

(58) Field of Classification Search

USPC ..... 439/140, 144, 676, 342, 131, 344, 946, 439/638

See application file for complete search history.

(56) References Cited

U.S. PATENT DOCUMENTS

| | | | | |
|---|---|---|---|---|
| 5,634,802 | A * | 6/1997 | Kerklaan | 439/131 |
| 5,871,364 | A * | 2/1999 | Shinchi et al. | 439/144 |
| 6,142,834 | A * | 11/2000 | Liao | 439/676 |
| 6,971,921 | B1 * | 12/2005 | Lai | 439/676 |
| 7,175,449 | B2 * | 2/2007 | Lai | 439/140 |

(Continued)

FOREIGN PATENT DOCUMENTS

| | | |
|---|---|---|
| TW | M364314 | 9/2009 |
| TW | M364991 | 9/2009 |

(Continued)

OTHER PUBLICATIONS

"Office Action of Taiwan Counterpart Application", issued on Sep. 3, 2014, p. 1-p. 7, in which the listed references were cited.

*Primary Examiner* — Jean F Duverne

(74) *Attorney, Agent, or Firm* — Jianq Chyun IP Office

(57) ABSTRACT

A receptacle connector adapted to be assembled to a printed circuit board for receiving a plug connector is provided. The receptacle connector includes an insulating base, conductive terminals, a fixing base, and a cover. The insulating base is assembled to a first surface of the printed circuit board and has a recess. The conductive terminals are disposed in the insulating base. Each of the conductive terminals has a contact end. The contact ends are located in the recess. The fixing base is assembled to a second surface of the printed circuit board. The cover is pivoted to the fixing base. The plug connector is adapted for pushing the cover to rotate from a close position to an open position relative to the fixing base. When the cover is at the open position, a receiving space for receiving the plug connector is defined between the cover and the recess.

10 Claims, 4 Drawing Sheets

(56) References Cited

U.S. PATENT DOCUMENTS

| | | | | |
|---|---|---|---|---|
| 7,244,129 | B2 | 7/2007 | Reid et al. | |
| 7,331,812 | B2 * | 2/2008 | Nishio et al. | 439/342 |
| 7,841,876 | B2 * | 11/2010 | Lin et al. | 439/144 |
| 7,950,936 | B2 * | 5/2011 | Wang et al. | 439/144 |
| 8,465,304 | B2 * | 6/2013 | Yen | 439/131 |
| 8,758,032 | B2 * | 6/2014 | Liang et al. | 439/131 |

FOREIGN PATENT DOCUMENTS

| | | |
|---|---|---|
| TW | M438053 | 9/2012 |
| TW | I384696 | 2/2013 |

* cited by examiner

RECEPTACLE CONNECTOR

CROSS-REFERENCE TO RELATED APPLICATION

This application claims the priority benefits of U.S. provisional application Ser. No. 61/563,616, filed on Nov. 25, 2011. The entirety of the above-mentioned patent application is hereby incorporated by reference herein and made a part of this specification.

BACKGROUND OF THE INVENTION

1. Field of the Invention

The invention relates to a connector and particularly relates to a receptacle connector.

2. Description of Related Art

In the era of technology, our life is surrounded by many types of electronic devices and they make our life more convenient. In current electronic devices, an RJ-45 type receptacle connector is often used as the connector corresponding to a plug connector for connecting the electronic devices with network-related equipment.

However, in the trend that electronic devices are demanded to be miniaturized, the size of the receptacle connector has become a restriction on the development of miniaturization of electronic devices.

SUMMARY OF THE INVENTION

The invention provides a receptacle connector assembled to two opposite sides of a printed circuit board for reducing an overall height of the receptacle connector when installed on an electronic device.

The invention provides a receptacle connector adapted to be assembled to a printed circuit board for receiving a plug connector. The printed circuit board has a first surface and a second surface opposite thereto. The receptacle connector includes an insulating base, a plurality of conductive terminals, a fixing base, and a cover. The insulating base is adapted to be assembled to the first surface of the printed circuit board and has a recess. The conductive terminals are disposed in the insulating base. Each of the conductive terminals has a contact end located in the recess. The fixing base is adapted to be assembled to the second surface of the printed circuit board. The cover is pivoted to the fixing base. The plug connector is adapted for pushing the cover to rotate from a close position to an open position relative to the fixing base. When the cover is at the open position, a receiving space for receiving the plug connector is defined between the cover and the recess.

The invention provides a receptacle connector adapted to be assembled to a printed circuit board in a housing of an electronic device for receiving a plug connector. The printed circuit board has a first surface and a second surface opposite thereto. The receptacle connector includes an insulating base and a plurality of conductive terminals. The insulating base is adapted to be assembled to the first surface of the printed circuit board and has a recess. The conductive terminals are disposed in the insulating base. Each of the conductive terminals has a contact end located in the recess. When the plug connector is inserted into the receptacle connector, the receptacle connector confines the plug connector with the recess of the insulating base and a part of the housing of the electronic device at the side of the second surface of the printed circuit board.

The invention provides a receptacle connector adapted to be assembled to a printed circuit board in a housing of an electronic device for receiving a plug connector. The printed circuit board has a first surface and a second surface opposite thereto. The receptacle connector includes an insulating base and a plurality of conductive terminals. The insulating base is adapted to be assembled to the first surface of the printed circuit board and has a recess. The conductive terminals are disposed in the insulating base. Each of the conductive terminals has a contact end located in the recess. When the plug connector is inserted into the receptacle connector, a height of the plug connector is higher than a height of the recess of the insulating base.

Based on the above, in comparison with the conventional receptacle connector, the invention is to respectively assemble the insulating base and the fixing base to the first surface and the opposite second surface of the printed circuit board, so as to reduce the overall height of the receptacle connector when installed on the electronic device, thereby achieving miniaturization of the electronic device.

To make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
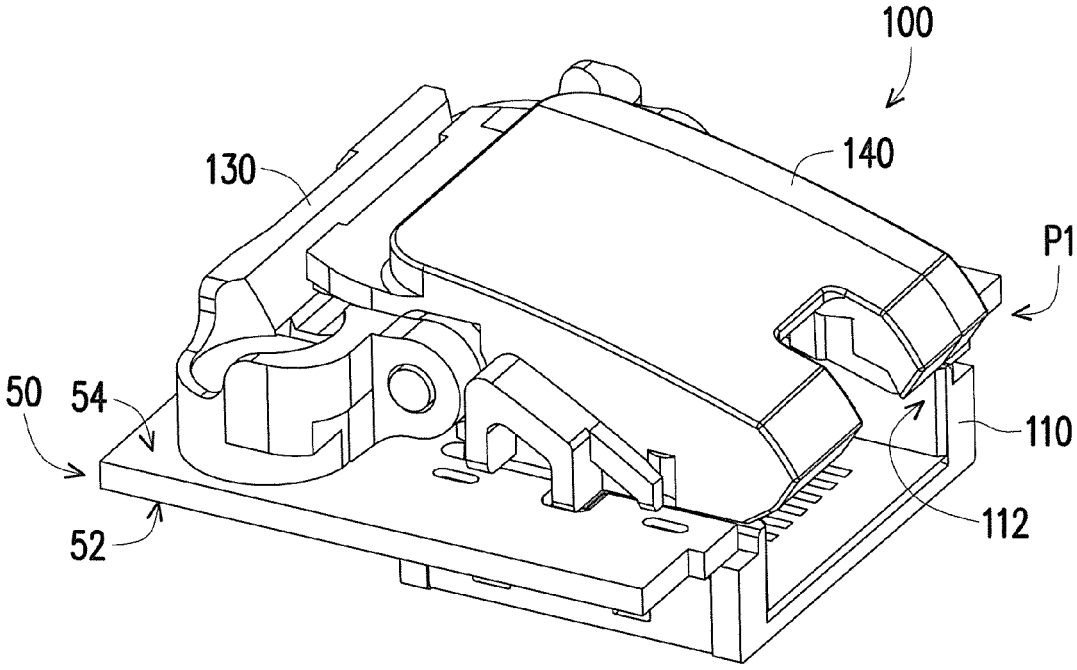
FIG. 1 is a schematic perspective view of a receptacle connector according to an embodiment of the invention.
Figure 2:
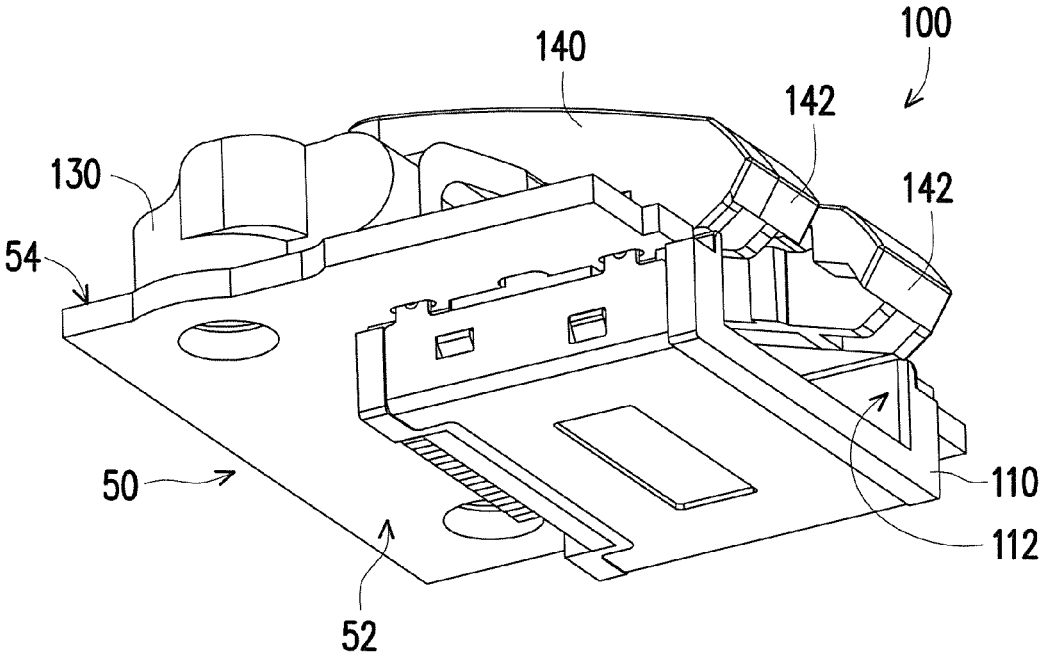
FIG. 2 is a schematic perspective view of the receptacle connector of FIG. 1 from another view angle.
Figure 3A:
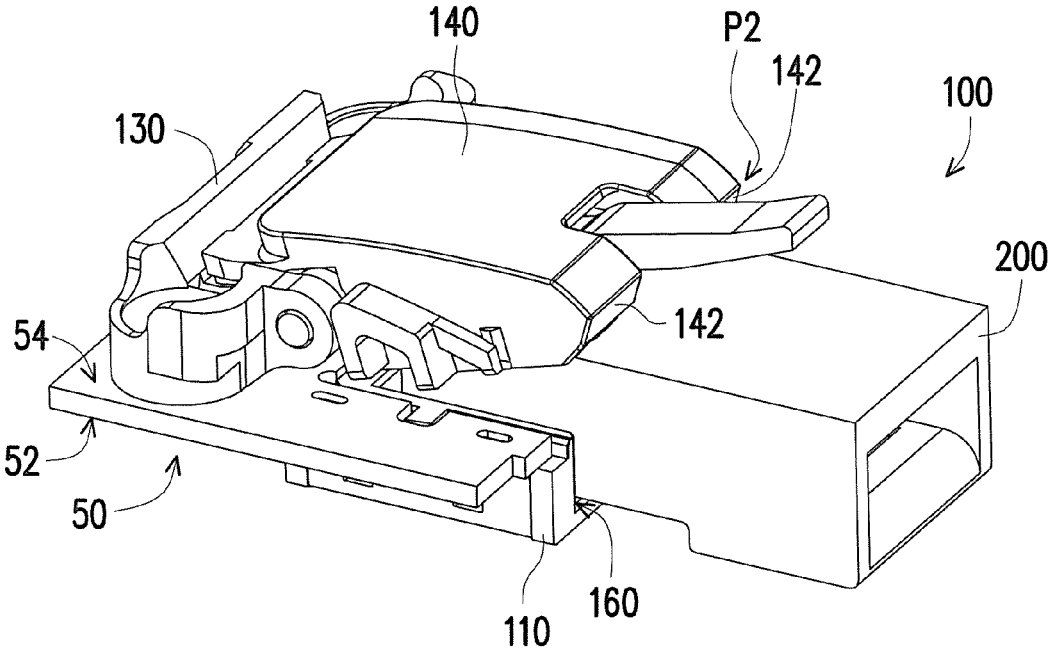
FIG. 3A is a schematic perspective view of the receptacle connector of FIG. 1 assembled with a plug connector.
Figure 3B:
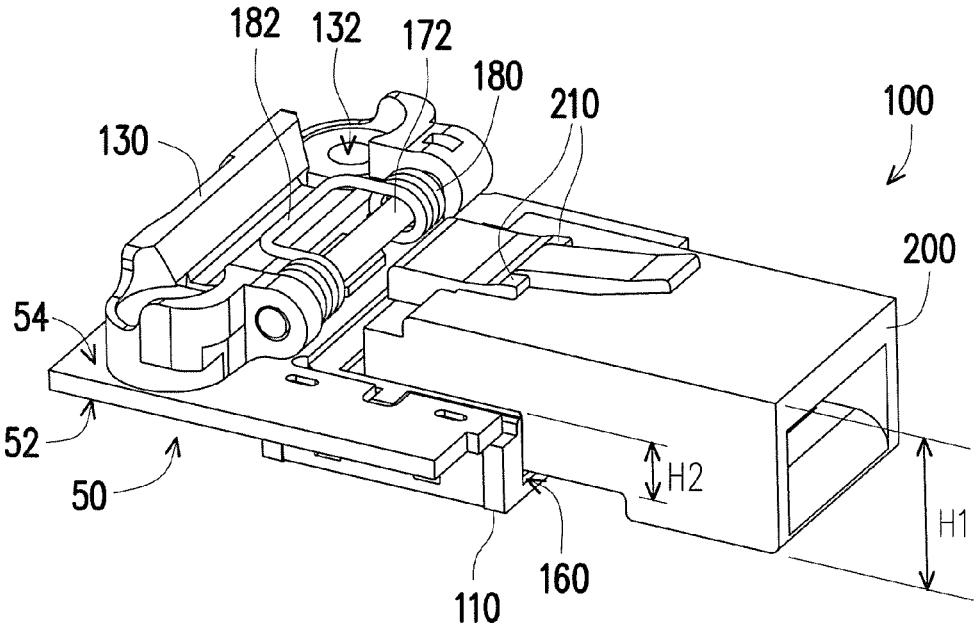
FIG. 3B provides another schematic perspective view of the receptacle connector of FIG. 1 assembled with the plug connector.

FIG. 1 is a schematic perspective view of a receptacle connector according to an embodiment of the invention. FIG. 2 is a schematic perspective view of the receptacle connector of FIG. 1 from another view angle. FIG. 3A is a schematic perspective view of the receptacle connector of FIG. 1 assembled with a plug connector. FIG. 3B provides another schematic perspective view of the receptacle connector of FIG. 1 assembled with the plug connector. It is noted that a cover is omitted from FIG. 3B for illustrating the components covered by the cover. Please refer to FIG. 1 to FIG. 3B to better understand the disclosure. In this embodiment, a receptacle connector 100 is an RJ-45 type receptacle connector, for example. The receptacle connector 100 is adapted to be assembled to a printed circuit board 50 for receiving a plug connector 200. The printed circuit board 50 has a first surface 52 and a second surface 54 opposite thereto. The receptacle connector 100 includes an insulating base 110, a plurality of conductive terminals 120 (see FIG. 4), a fixing base 130, and a cover 140. The insulating base 110 is adapted to be assembled to the first surface 52 of the printed circuit board 50 and has a recess 112. The conductive terminals 120 are disposed in the insulating base 110. Each of the conductive terminals 120 has a contact end 122 (see FIG. 4) located in the recess 112. The fixing base 130 is adapted to be assembled to the second surface 54 of the printed circuit board 50. The receptacle connector 100 may be installed inside a housing of an electronic device (not shown), and the cover 140 may be a part of the housing. Moreover, the cover is omitted in other embodiments, wherein the printed circuit board 50 and the insulating base 110 are used to confine the plug connector 200 or a part of the housing of the electronic device is used to confine the plug connector 200. In this embodiment, a height H1 of the plug connector 200 is higher than a height H2 of the recess 112 of the insulating base 110, as shown in FIG. 3, when the plug connector 200 is inserted into the receptacle connector 100.

Figure 4:
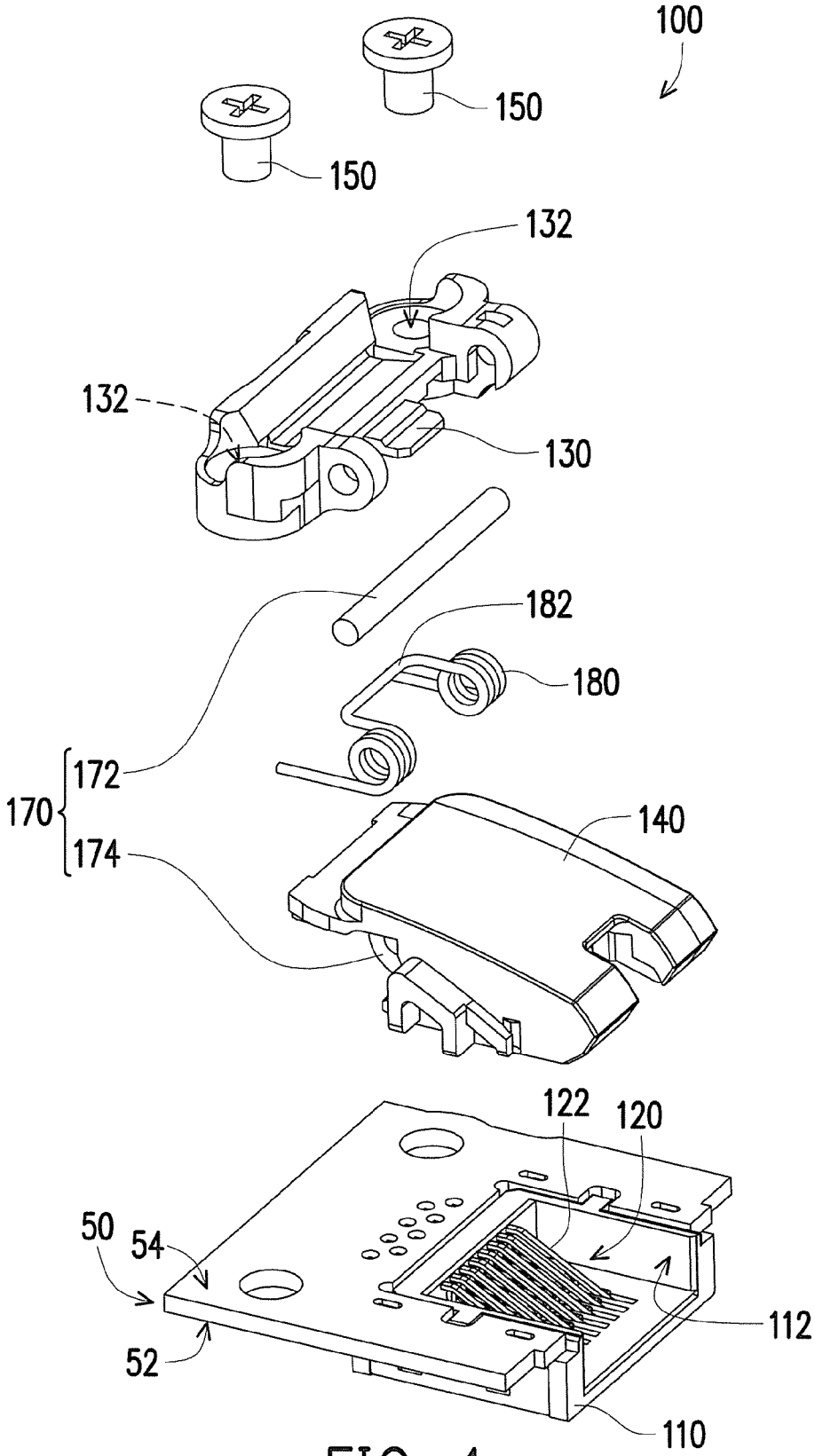
FIG. 4 is a schematic exploded view of the receptacle connector of FIG. 1.
Figure 5:
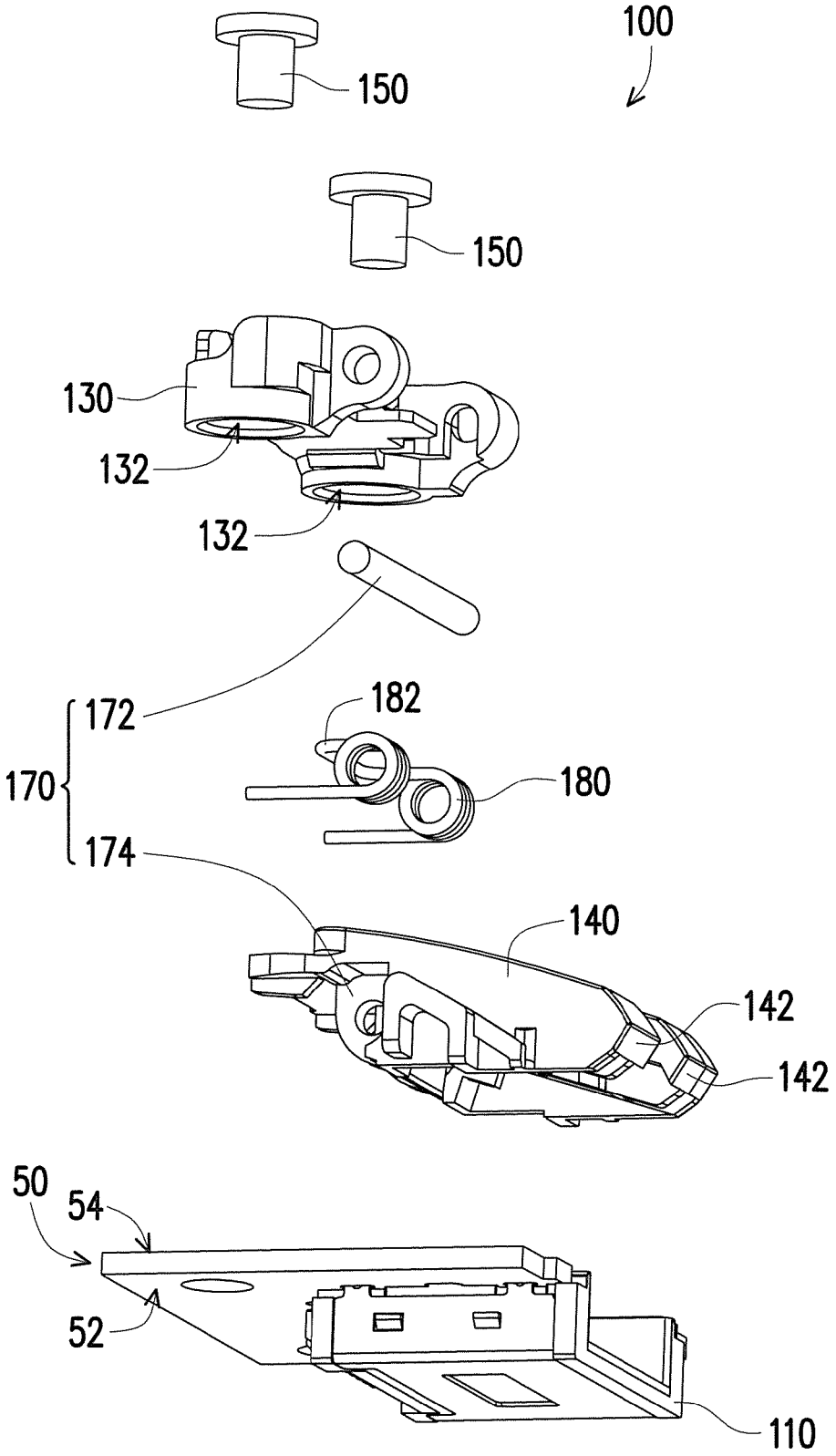
FIG. 5 is a schematic exploded view of the receptacle connector of FIG. 1 from another view angle.

FIG. 4 is a schematic exploded view of the receptacle connector of FIG. 1. FIG. 5 is a schematic exploded view of the receptacle connector of FIG. 1 from another view angle. Referring to FIGS. 3B, 4, and 5, in this embodiment, the receptacle connector 100 further includes a plurality of fixing elements 150 (two are shown in the figures). The fixing base 130 has a plurality of fixing holes 132 (two are shown in the figures). The fixing elements 150 are adapted to pass through the fixing holes 132 for fixing the fixing base 130 to the printed circuit board 50, thereby assembling the fixing base 130 to the printed circuit board 50. In this embodiment, the cover 140 is pivoted to the fixing base 130 and has a plurality of cover hooks 142 (two are shown in the figures). The plug connector 200 includes a plurality of plug hooks 210.

In this embodiment, the plug connector 200 is adapted for pushing the cover 140 to rotate from a close position P1 shown in FIG. 1 to an open position P2 shown in FIG. 3A relative to the fixing base 130. When the cover 140 is at the open position P2 shown in FIG. 3A, a receiving space 160 for receiving the plug connector 200 is defined between the cover 140 and the recess 112. Moreover, the cover hooks 142 of this embodiment are adapted to hook on to the corresponding plug hooks 210, so as to position the plug connector 200 in the insulating base 110.

In comparison with the conventional receptacle connector, the configuration of this embodiment is to respectively assemble the insulating base 110 and the fixing base 130 to the first surface 52 and the second surface 54 of the printed circuit board 50, so as to reduce the overall height of the receptacle connector 100 when installed on an electronic device. In addition, corresponding to the assembly of the receptacle connector 100, the cover 140 is pivoted to the fixing base 130. In other words, the cover 140 is directly pivoted to the insulating base 110. Nevertheless, it is noted that the disclosure of the invention is not intended to restrict how the cover 140 is pivoted to the fixing base 130. The following paragraphs further explain the mechanism for pivoting the cover 140 of the receptacle connector 100 to the fixing base 130.

In this embodiment, the receptacle connector 100 further includes a pivot mechanism 170. The pivot mechanism 170 is disposed between the fixing base 130 and the cover 140, and the cover 140 is pivoted to the fixing base 130 by the pivot mechanism 170. The pivot mechanism 170 of this embodiment includes a rotating shaft 172 and a bearing 174. The rotating shaft 172 is inserted into the bearing 174. The rotating shaft 172 is fixed on the fixing base 130. The cover 140 is fixed on the rotating shaft 172, and the bearing 174 is fixed on the fixing base 130. It is noted that, in this embodiment, the bearing 174 and the fixing base 130 are an integrated structure, for example. However, the invention is not limited to the above. In some of the embodiments, the bearing may be assembled to the fixing base.

In addition, the receptacle connector 100 further includes an elastic element 180. The elastic element 180 is a torsion spring, for example, connected between the fixing base 130 and the cover 140. More specifically, the rotating shaft 172 is inserted into a part of the elastic element 180, and the elastic element 180 has an extension part 182. The cover 140 and the extension part 182 are assembled to each other. Accordingly, when an external force is applied on the plug connector 200 to move the cover 140, the cover 140 rotates against an elastic force of the elastic element 180 from the close position P1 shown in FIG. 1 to the open position P2 shown in FIG. 3A relative to the fixing base 130. When an external force is applied on the plug connector 200 to move the plug connector 200 away from the cover 140, the cover 140 is rotated by the elastic force of the elastic element 180 from the open position P2 shown in FIG. 3A to the close position P1 shown in FIG. 1 relative to the fixing base 130.

To conclude the above, in comparison with the conventional receptacle connector, the invention is to respectively assemble the insulating base and the fixing base to the first surface and the opposite second surface of the printed circuit board, so as to reduce the overall height of the receptacle connector when installed on an electronic device, thereby achieving miniaturization of the electronic device.

It will be apparent to those skilled in the art that various modifications and variations can be made to the disclosed embodiments without departing from the scope or spirit of the invention. In view of the foregoing, it is intended that the invention covers modifications and variations of this disclosure provided that they fall within the scope of the following claims and their equivalents.

What is claimed is:

1. A receptacle connector, adapted to be assembled to a printed circuit board comprising a first surface, a second surface opposite thereto, and a convex-concave portion formed along an edge of the first and second surfaces to receive a plug connector, the receptacle connector comprising:

an insulating base assembled to the first surface of the printed circuit board and comprising a recess;

a plurality of conductive terminals disposed in the insulating base, wherein each of the conductive terminals comprises a contact end located in the recess, wherein a concave part of the convex-concave portion is disposed corresponding to the recess;

a fixing base assembled to the second surface of the printed circuit board; and a cover pivoted to the fixing base, wherein the plug connector is adapted to push the cover to rotate from a close position to an open position relative to the fixing base, and a receiving space for receiving the plug connector is defined between the cover and the recess when the cover is at the open position.

2. The receptacle connector according to claim 1, further comprising:

a pivot mechanism disposed between the fixing base and the cover, wherein the cover is pivoted to the fixing base by the pivot mechanism.

3. The receptacle connector according to claim 2, wherein the pivot mechanism comprises a rotating shaft and a bearing, the rotating shaft is inserted into the bearing and fixed to the fixing base, the cover is fixed to the rotating shaft, and the bearing is fixed to the fixing base.

4. The receptacle connector according to claim 2, further comprising:

an elastic element connected between the fixing base and the cover, wherein the plug connector receives an external force to move the cover and rotate the cover against an elastic force of the elastic element from the close position to the open position relative to the fixing base; and the plug connector receives an external force to move away from the cover and the cover is rotated by the elastic force of the elastic element from the open position to the close position relative to the fixing base.

5. The receptacle connector according to claim 4, wherein the rotating shaft is inserted into a part of the elastic element, and the elastic element comprises an extension part assembled to the cover.

6. The receptacle connector according to claim 1, further comprising:

a fixing element, wherein the fixing base comprises a fixing hole, and the fixing element passes through the fixing hole to fix the fixing base to the printed circuit board for assembling the fixing base to the printed circuit board.

7. The receptacle connector according to claim 1, wherein the cover comprises a cover hook and the plug connector comprises a plug hook, and the cover hook hooks on to the plug hook to position the plug connector in the insulating base when the cover is at the open position.

8. The receptacle connector according to claim 1, wherein the receptacle connector is installed in a housing of an electronic device, and the cover of the receptacle connector forms a part of the housing.

9. A receptacle connector, adapted to be assembled to a printed circuit board, which comprises a first surface, a second surface opposite thereto, and a convex-concave portion formed along an edge of the first and second surfaces, in a housing of an electronic device to receive a plug connector, the receptacle connector comprising:

an insulating base assembled to the first surface of the printed circuit board and comprising a recess, wherein a concave part of the convex-concave portion is disposed corresponding to the recess; and a plurality of conductive terminals disposed in the insulating base, wherein each of the conductive terminals comprises a contact end located in the recess;

wherein, when the plug connector is inserted into the receptacle connector, the receptacle connector confines the plug connector with the recess of the insulating base, the concave part of the printed circuit board, and a part of the housing of the electronic device at a side of the second surface of the printed circuit board.

10. A receptacle connector, adapted to be assembled to a printed circuit board, which comprises a first surface, a second surface opposite thereto, and a convex-concave portion formed along an edge of the first and second surfaces, in a housing of an electronic device to receive a plug connector, the receptacle connector comprising:

an insulating base assembled to the first surface of the printed circuit board and comprising a recess facing toward the first surface of the printed circuit board, wherein a concave part of the convex-concave portion is disposed corresponding to the recess; and a plurality of conductive terminals disposed in the insulating base, wherein each of the conductive terminals comprises a contact end located in the recess;

wherein when the plug connector is inserted into the receptacle connector, a height of the plug connector is higher than a height of the recess of the insulating base.

* * * * *